US006736490B2

(12) United States Patent
Sugioka

(10) Patent No.: US 6,736,490 B2
(45) Date of Patent: May 18, 2004

(54) INK JET RECORDING HEAD AND NON-LINEAR ELECTRICAL ELEMENT

(75) Inventor: Hideyuki Sugioka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/392,947

(22) Filed: Mar. 21, 2003

(65) Prior Publication Data

US 2003/0197761 A1 Oct. 23, 2003

(30) Foreign Application Priority Data

Mar. 29, 2002 (JP) ..... 2002-096257

(51) Int. Cl.[7] ..... B41J 2/05
(52) U.S. Cl. ..... 347/56; 347/61
(58) Field of Search ..... 347/56, 61; 219/216

(56) References Cited

U.S. PATENT DOCUMENTS

| | | | |
|---|---|---|---|
| 6,386,685 | B1 | 5/2002 | Sugioka |
| 6,499,833 | B2 | 12/2002 | Sugioka |
| 2001/0048450 | A1 | 12/2001 | Sugioka |
| 2002/0021329 | A1 | 2/2002 | Sugioka |
| 2002/0021332 | A1 | 2/2002 | Sugioka |
| 2002/0021333 | A1 | 2/2002 | Sugioka |

FOREIGN PATENT DOCUMENTS

| | | |
|---|---|---|
| JP | 62-201254 | 9/1987 |
| JP | 4-97927 | 3/1992 |
| JP | 5-47457 | 2/1993 |
| JP | 5-258840 | 10/1993 |
| JP | 8-15629 | 1/1996 |
| JP | 2001-71499 | 3/2001 |
| JP | 2001-71500 | 3/2001 |
| JP | 2002-46274 | 2/2002 |
| JP | 2002-46275 | 2/2002 |
| JP | 2002-67325 | 3/2002 |
| JP | 2002-67326 | 3/2002 |

*Primary Examiner*—Michael S Brooke
(74) *Attorney, Agent, or Firm*—Fitzpatrick, Cella, Harper & Scinto

(57) ABSTRACT

An ink jet recording head is provided with a base plate with an ink supply port being open as a through hole having laminated thereon a heat accumulation layer and further thereon, two metallic layers serving as metallic electrodes, and a PTC thermistor layer and an electrical barrier layer, which are arranged between them. The PTC thermistor layer is formed by the PTC thermistor having the positive resistance temperature coefficient that raises resistance abruptly beyond a predetermined temperature. With the structure thus arranged, it becomes possible to suppress unnecessary heating of heat generating means so as to prevent the heat generating means from becoming excessively high temperature. It is preferable to adjust the predetermined temperature to be slightly higher than the bubbling temperature of liquid, particularly to 250 to 490° C.

13 Claims, 5 Drawing Sheets

INK JET RECORDING HEAD AND NON-LINEAR ELECTRICAL ELEMENT

BACKGROUND OF THE INVENTION

1. Field of the Invention

The present invention relates to an ink jet printer. More particularly, the invention relates to an ink jet recording head used for the bubble jet printer that utilizes bubbling phenomenon, and the like, and to a non-linear electrical element as well.

2. Related Background Art

As regards the technology of non-linear current voltage element, there has been proposed since a long time ago the PTC thermistor having the non-linear characteristic in which the resistance value rises enormously at a certain temperature (curie temperature), and this thermistor has been utilized for various products. For example, there has been proposed in the specification of Japanese Patent Laid-Open Application No. 05-47457 an organic face heat-generating element having the positive temperature coefficient (PTC) characteristic. Also, in the specification of Japanese Patent Laid-Open Application No. 05-258840, there has been proposed a PTC heat-generating device provided with plural PTC elements connected in parallel. Also, in the specification of Japanese Patent Laid-Open Application No. 04-97927, there has been disclosed an ink discharge apparatus that holds the temperature of ink within a desired range of temperature using PTC thermistor heat generating element.

Also, regarding the technology of the non-linear current voltage element, there have been proposed in the specifications of Japanese Patent Laid-Open Application Nos. 2001-71499, 2002-046274, 2002-046275, 2002-067325, and 2002-067326 the applications of MIM element to the bubble jet recording head having the current voltage characteristic (the so-called MIM type current voltage characteristics) in which almost no current runs at a certain voltage or less, and current is allowed to run at a certain voltage or more.

FIG. 7 is a conceptual view that shows the MIM type electrical characteristic. Here, it is desirable to make the current voltage characteristic of the non-linear element the one in which only a sufficiently small current is allowed to run by the application of voltage of a small absolute value on either sides of the positive voltage and negative voltage so that the non-linear element does not generate heat even by the application of non-selective voltage having unsettled polarity. Therefore, as shown in FIG. 7, it is particularly desirable for the current voltage characteristic of non-linear element to set the ratio ($V_1/V_2$) at a value of 0.5 to 2.0 for the absolute values between the $+V_1$ and $-V_2$ of the applied voltage that gives current of the absolute value $I_0$, which is equivalent to the current running at the time of voltage application that enables a desired bubbling to be generated. Then, it is also desirable to make the absolute value $I_0/10$ or less for the current that runs when the voltage of $+V_1/2$ and $-V_2/2$ is applied.

On the other hand, regarding the technology of the ink jet recording head, it is generally practiced to provide a recording head, which is applicable to a bubble jet recording method, with fine discharge ports for discharging liquid, flow path to conduct liquid to each discharge port, and heat generating means arranged for a part of each flow path. The bubble jet recording method is a recording method, in which liquid is heated locally in the flow path to a high temperature by use of heat generating means so as to bubble it to generate bubble, and then, by the utilization of such high pressure exerted at the time of bubbling, liquid is pushed out from each of the fine discharge ports so as to enable it to adhere to a recording sheet or the like for recording.

In order to make images highly precise, which are recorded by the recording technology of the kind, it is necessary to discharge extremely fine liquid droplets from the discharge ports arranged in high density. Fundamentally, therefore, it is important to form minute flow paths and minute heat generating means as well. Then, for the bubble jet recording method, a method has been proposed for forming a recording head by using photolithographic process freely, while taking advantage of the simplicity of the structure thereof, so as to arrange discharge ports, flow paths, and heat generating elements in high density for the head (see the specification of Japanese Patent Laid-Open Application No. 08-15629, for example). Also, the discharge amount of liquid droplets should be adjusted in order to discharge fine liquid droplets. To this end, a proposal has been made to use the heat-generating element the amount of heat generation of which is larger in the central portion than the edge portions thereof (see the specification of Japanese Patent Laid-Open Application No. 62-201254).

As heat generating means, it is usually practiced to use the resistive heat-generating element, which is formed by a thin film of tantalum nitride formed in a thickness of approximately 0.05 $\mu$m. When this element is energized, joule heat is generated to bubble liquid. On such resistive heat-generating element, there is arranged a cavitation-proof layer formed by metal, such as Ta, in a thickness of approximately 0.2 $\mu$m usually though an insulator, such as Sin, formed in a thickness of approximately 0.8 $\mu$m in order to prevent the surface of the resistive heat-generating element from being damaged by cavitation.

For the aforesaid recording head that adopts the bubble jet recording method, the resistive heat-generating element for use of ink bubbling usually presents variations to a certain extent due to the resistance of its own finish and the resistance generated by the connected wiring. As a result, even if voltage is applied under constant condition, there occur variations in the voltage drop due to resistance, and the heating amount of the heater formed by such resistive heat-generating element tends to vary accordingly. Therefore, for the reasons that any influences that may be given to the inferior image quality due to such variation of heating amount should be avoided, among some others, the driving voltage, which is required for driving the heater array formed by plural heaters, is provided with a higher voltage value than the voltage value needed usually for the stabilized bubbling on the entire surface of each individual resistive heat-generating element, which faces liquid. Such voltage value is particularly set at as much as approximately 1.2 times the required voltage value.

However, when the driving voltage is set at a higher value as described above, an excessive voltage is applied to the average heater beyond the voltage needed for the bubbling on the entire surface. As a result, there encountered a problem, in principle, that unwanted heating continues even after bubbling.

More specifically, if a heater is driven with 1 $\mu$s-pulse, for example, it is typical that bubbling takes place at approximately 6 $\mu$s, and than, unwanted heating (excessive heating) by the heater continues after bubbling, thus causing the heater surface to reach typically at a temperature of as high as 600 to 700° C. approximately against the bubbling temperature of 300° C. approximately. Then, depending on conditions, there is a problem that such temperature is made higher still.

To described this problem further in detail, due to the principle of the continuation of excessive heating described above, there is a fire that the following problems are encountered:

(1) In terms of effective utilization of energy, it is not preferable to supply energy wastefully after bubbling.

(2) It is necessary to design the heat resistance of the heater material at a value higher than needed in consideration of the principle cause to make the heater temperature excessively high.

Also, depending on cases, this may bring about thermal destruction, and the deterioration of durability by the repeated abrupt change of temperatures.

Under the circumstances, if it is possible to materialize the heater for bubble jet use, which is capable of suppressing the excessive heating after bubbling, there is a possibility to be able to provide a head for bubble jet use that should be preferable from the viewpoint of energy saving and enhanced durability, and the prevention of thermal destruction as well.

Meanwhile, it is a prerequisite for many of the conventional heads that heat generating elements, diodes, and logic circuitry are incorporated on a silicon base plate simultaneously by means of semiconductor process (such method as ion implantation). As a result, the head the number of nozzles of which is comparatively small can be formed compactly with an advantage that it can be manufactured in a single process. However, in a case of a multiple head that has a full length to cover the width of a recording sheet, a length of approximately 305 mm is needed if it is formed integrally. This makes it difficult to use usual silicon wafer, and there is a fear that the method of manufacture that should be adopted therefor becomes highly costly.

Therefore, if it is possible to perform the matrix drive of the heat generating element for bubbling use by use of the MIM element that can be produced without depending on the conventional semiconductor process, such as ion implantation, there is a possibility to provide an elongated ink jet head at low costs.

Also, for the resistive heat-generating element of the heater portion of a recording head for use of bubble jet, it is necessary to supply a power having the density of approximately 0.1 $GM/m^2$ or more to the resistive element serially connected with MIM element or to the MIM element itself. Then, there is a fear to invite the destruction of the MIM element itself by the large electrical current. The power loss caused by such MIM element itself is largely small in the conventional MIM-application products, such as a liquid crystal display. There has been no problem at all. In other words, the problem encountered here is conceivably the one related particularly to the MIM element for the bubble jet use that deals with a large power.

Here, in particular, there is a fear for the conventional MIM element that electrical current is concentrated on the portion having a narrower gap between electrodes if the distance between electrodes varies, which makes uniform heat generating difficult.

FIG. 8 is a view that shows one example of the temporal changes of temperature distribution by the MIM element that has in-plane variations with respect to the gap between electrodes or the like. For the MIM element, if there exists such in-plane variation with respect to the gap between electrodes or the like, electrical current concentrates on the narrower portion of the electrode gap at first. As a result, the uneven distribution of temperature takes place at the outset. Then, in continuation, the resistance value of the high-temperature portion is made lower due to the NTC (negative temperature coefficient) of the resistance value of the tunnel current. As a result, the high-temperature portion is in a state of having higher temperature, thus leading to the destruction. In this respect, as the electrical conduction mechanism in the insulator of the MIM element, there have been known an electrical conduction of hopping type where plural tunnel actions are repeated in a conductor such as the conduction of Poole-Frenkel type, a comparatively simple tunnel conduction such as the conduction of Fowler-Nordhaim type, and the like.

Also, for the MIM element, if the concentration of electrical current occurs as described earlier, the resistance of the portion where the current concentration takes place is made lower still and the temperature rises further due to the NTC (negative temperature coefficient) characteristic of the resistance value of the MIM element resulting from the tunnel current.

SUMMARY OF THE INVENTION

Now, therefore, the present invention is designed in consideration of the problems discussed above. It is an object of the invention to provide a non-linear electrical element having the electrical characteristic of MIM type that functions protect the element automatically from unwanted temperature rise.

Also, it is another object of the invention to provide a highly durable, energy saving ink jet recording head, which is capable of providing an elongated head at lower costs.

In order to achieve the aforesaid objects, the ink jet recording head of the present invention is an ink jet recording head for discharging liquid by bubbling liquid with heat generating means. This heat generating means is provided with a laminated member having a pair of electrodes, a resistance layer having positive resistance temperature coefficient that raises resistance value abruptly when temperature rises higher than a predetermined temperature, and an insulation layer for enabling electrical current to run by the application of voltage higher than a predetermined voltage. Here, the pair of electrodes sandwich the resistance layer having the positive resistance temperature coefficient, and the insulation layer.

Also, it may be possible to arrange the thickness of the insulation layer of the ink jet recording head of the invention to be 4 nm or more and 40 nm or less.

Also, for the ink jet recording head of the invention, the temperature, which causes the resistance value of the resistance layer having the positive resistance temperature coefficient to rise abruptly, may be arranged to be near the bubbling temperature of liquid or 250° C. or more and 490° C. or less.

Further, the ink jet recording head of the invention may be the one in which the heat generating means is formed essentially by serially connecting MIM element and PTC thermistor, and the insulation layer does not allow electrical current to run even by the application of voltage lower than a predetermined voltage, and allows electrical current to run by the application of voltage higher than the predetermined voltage, and then, the resistance layer cuts electrical current after bubbling of liquid.

Also, the ink jet recording head of the invention may be the one which comprises a pair of electrodes; a resistance layer having the positive resistance temperature coefficient raising resistance value abruptly when temperature rises higher than a predetermined temperature; an insulation layer allowing electrical current to run by the application of voltage higher than a predetermined voltage; and an insulating member having a contact hole formed therefor. For this ink jet recording head, the pair of electrodes sandwich the resistance layer having the positive resistance temperature coefficient, and the insulation layer in the contact hole.

The non-linear electrical element of the invention is a non-linear electrical element having non-linear resistive characteristic, which comprises a pair of electrodes; a resistance layer having the positive resistance temperature coefficient raising resistance value abruptly when temperature rises higher than a predetermined temperature; and an insulation layer allowing electrical current to run by the application of voltage higher than a predetermined voltage. For this non-linear electrical element, the pair of electrodes sandwich the resistance layer having the positive resistance temperature coefficient, and the insulation layer.

Also, for the non-linear electrical element of the invention, it may be possible to arrange the thickness of the insulation layer to be 4 nm or more and 40 nm or less or to make it essentially a laminated structure formed by a serial circuit of MIM element and PTC thermistor.

Further, the non-linear electrical element of the invention may be the one, which comprises a pair of electrodes; a resistive heat generating element sandwiched between the pair of electrodes, having the positive resistance temperature coefficient raising resistance value abruptly when temperature rises higher than a predetermined temperature; an electrical insulating element covered by the resistive heat generating element, having a contact hole formed therefor to enable one electrode of the pair of electrodes to be electrically connected with the resistive heat generating element; and an insulation layer covering one of the electrodes in the contact hole to allow electrical current to run by the application of voltage higher than a predetermined voltage.

The ink jet recording head of the present invention described above is provided with a pair of electrodes, a resistance layer having positive resistance temperature coefficient that raises resistance value abruptly when temperature rises higher than a predetermined temperature, and an insulation layer for enabling electrical current to run by the application of voltage higher than a predetermined voltage. Then, the laminated element, in which the pair of electrodes sandwich the resistance layer having the positive resistance temperature coefficient, and the insulation layer, constitutes heat-generating means. In other words, the heat-generating means of the ink jet recording head of the present invention forms essentially a serial circuit formed by MIM element and PTC thermistor. Thus, electrical current does not run by the application of voltage lower than a predetermined voltage, but it is allowed to run when voltage higher than the predetermined voltage is applied. FIG. 9 is a diagram that shows the heat-generating means of the ink jet recording head of the present invention as an equivalent circuit of MIM element 101 and PTC thermistor 100.

As indicated in the matrix circuit diagram shown in FIG. 10, it is possible to form the matrix circuit capable of performing matrix driving for the ink jet recording head of bubble jet type by means of the serial circuit of the MIM element 101 and the PTC thermistor 100 for. In other words, with the arrangement of heat-generating means on each intersecting point of the wiring in the column direction X1, X2, . . . and the line direction Y1, Y2, . . . , it is made possible to enable electrical current to run by the application of voltage higher than the voltage existing across a pair of electrodes for generating heat, and then, heat-generating means heats liquid for bubbling, and then, after bubbling, electrical current is automatically cut by means of the PTC thermistor even in a state of voltage being applied. Here, when the applied voltage is lower than the voltage existing across the pair of electrodes, electrical current does not run, thus generating no heat. In other words, the ink jet recording head of the present invention makes it possible to automatically cut electrical current even in a state of voltage being applied for the prevention of excessive heat generation. Therefore, at the same time that the excessive energy consumption is suppressed, heat-generating means is prevented from being damaged so as to enhance the durability of heat-generating means.

Also, with the arrangement of the non-linear element that presents MIM type current voltage characteristics on each intersecting point of the matrix electrodes as described above, unwanted heat generation by the bias voltage at the time of matrix driving, which takes place on the points yet to be selected, can be suppressed, hence making it possible to perform the matrix driving of heaters. Also, by the matrix driving, it becomes easer to separate driver and heater, which produces an effect that makes a large-scale production possible by use of inexpensive non-Si base plate.

Also, the non-linear electrical element of the present invention described above is provided with the resistive heat-generating element having the positive resistance temperature coefficient that raises resistance value abruptly when temperature rises more than a predetermined temperature, and the electrical insulating layer that covers the resistive heat-generating element, thus making it possible to suppress electrical current running to the current concentrated portion by enabling the specific resistance of the resistance layer to rise abruptly, while maintaining the characteristics of the MIM element, even if the current concentration should take place to raise the element temperature locally. In this manner, it is possible to stably deal with the large current enormously great in the turned-on condition, which is the feature of the MIM type current voltage characteristics.

Also, with the thickness of the insulation layer of 4 nm or more and 40 nm or less, it is made possible to give preferable MIM type electrical characteristics to the matrix driving of the liquid discharge unit of the bubble jet type.

As the electric conduction mechanism of the insulating member of the MIM element, there has been known the hopping type electric conduction where plural tunneling actions are repeated in the insulating member, such as Poole-Frenkel type conduction or a comparatively simple tunneling conduction such as Fowler-Nordhaim type conduction, among some others.

In order to allow electrical current of tunnel type to flow so that the electrical current runs on the junction element, there is a need for making the gap between electrodes extremely narrow. The limit of the film thickness of the insulating member where electrical current flows to the MIM element or the limit of electrode gap depends largely on the kinds of the insulating material and electrode material, and the conduction mechanism as well. However, it is desirable to make the electrode gap 100 nm or less, for example, in order to enable the useful electrical current to run as the MIM element. Further, it is preferable to make the electrode gap 40 nm or less in order to obtain the large current, which is needed to drive the bubble jet recording head, at low voltage. Also, there is a fear that ion on the metallic surface of electrodes generates electric field radiation if the electrode gap is too narrow. Therefore, it is desirable to make the electrode gap 1 nm or more. Further, in order to obtain the tunnel junction that generates stable tunnel conduction, the electrode gap should be made 4 nm or more. In other words, it is particularly preferable to use the MIM element having the electrode distance of 1 nm or more and 100 nm or less, or more preferably, 4 nm or more and 40 nm or less, as the non-linear element.

Also, with the arrangement to make the temperature, at which the resistance layer having the aforesaid positive resistance temperature coefficient is raised abruptly, to be near the bubbling temperature of liquid, electrical current is automatically cut immediately after bubbling. Also, the temperature of the kind should preferably be 250° C. or more and 490° C. or less in consideration of the tendency that the bubbling temperature of ink in general, and the surface temperature of the heat-generating element, which is in contact with ink, are made lower than the inner temperature of the heat-generating element.

As has been described, in accordance with the present invention, it is possible to provide the non-linear electrical element having MIM type electrical characteristics, which is provided with the function to protect the element automatically from the unwanted temperature rise, while providing an energy-saving, highly durable elongated ink jet recording head at low costs.

DETAILED DESCRIPTION OF THE PREFERRED EMBODIMENTS

Next, with reference to the accompanying drawings, the description will be made of the embodiment in accordance with the present invention.

First Embodiment

Figure 1:
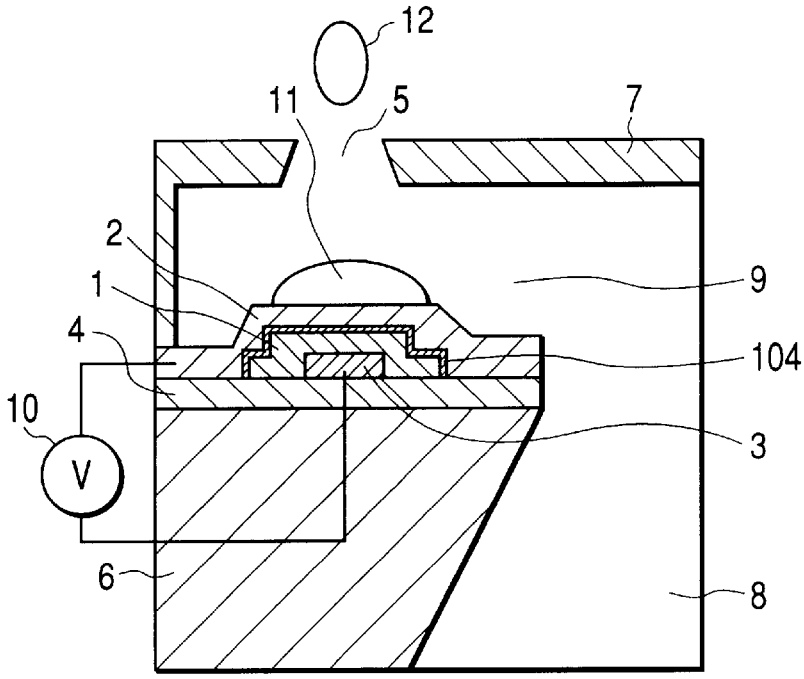
FIG. 1 is a cross-sectional view that schematically shows an ink jet recording head in accordance with a first embodiment of the present invention.
Figure 2:
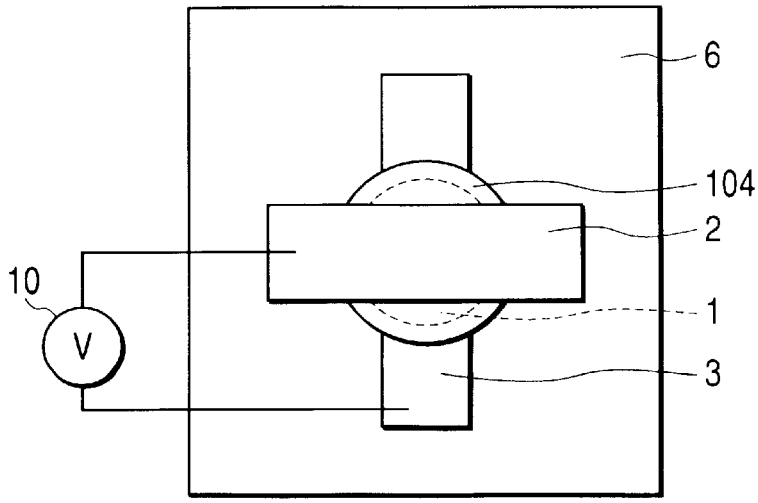
FIG. 2 is a plan view that shows the heater portion of the ink jet recording head represented in FIG. 1.

FIGS. 1 and 2 are views that schematically illustrate an ink jet recording head in accordance with a first embodiment. FIG. 1 is a cross-sectional view. FIG. 2 is a plan view. FIGS. 1 and 2 illustrate one heater portion for bubbling use. The entire body of the ink jet recording head may be structured so as to arrange plural heater portions for bubbling use shown in FIGS. 1 and 2.

This ink jet recording head is provided with a base plate 6 having the ink supply port 8 which is open as a through hole. On the upper face of the base plate 6, a heat accumulation layer 4 is formed, and further thereon, there are laminated the two metal layers, which become metallic electrodes 2 and 3, and the PTC thermistor layer 1 and electrical barrier layer 104, which are arranged between the electrodes. In accordance with the example shown in FIG. 2, the two metallic electrodes 2 and 3 are formed flat in the form of a stripe, respectively, and cross each other. The PTC thermistor layer 1 and the electrical barrier layer 104, that is, an electrically insulating thin film, are arranged in a position where the two metallic electrodes 2 and 3 intersect each other. In other words, on the base plate 6, the metallic electrode 3, the PTC thermistor layer 1, the electric barrier layer 104, and the metallic electrode 2 are laminated in that order to form the heater for bubbling use.

Further, on the base plate 6, there is arranged the nozzle formation member 7 that forms a flow path 9 and a discharge port 5. The discharge port 5 is open to the position that faces the heater for bubbling use. Also, although not shown in FIGS. 1 and 2 in detail, the ink flow path 9 is connected from the supply port 8 onto the heater for bubbling use, and plural ink flow paths 9 are formed and connected onto plural heaters for bubbling use, respectively.

For this ink jet recording head, when voltage is applied from a driving voltage application source 10 across the two metallic electrodes 2 and 3, electrical current runs to the non-linear current voltage element, which is formed by the PTC thermistor layer 1, the metallic electrodes 2 and 3, and the electric barrier layer 104, thus generating joule heat. By means of this joule heat, the liquid (ink), which is filled in the flow path 9 is bubbled to generate a bubble 11, and by the pressure exerted at the time of bubbling, a discharge liquid droplet 12 is discharged from the discharge port 5.

The driving voltage application source 10 is usually provided for the ink jet recording apparatus main body, and voltage is selectively applied to the heater for bubbling use at predetermined timing. In FIGS. 1 and 2, the representation of these structures is omitted. Only the driving voltage application source 10 is schematically shown. Also, the ink supply port 8 is connected with an ink supply source (not shown), and after the discharge liquid droplet 12 has been discharged, liquid is induced from the ink supply source into the flow path 9 to fill it through the ink supply port 8 along with the extinction of bubble.

In accordance with the present embodiment, it is possible for the base plate 6 to use the Si base plate, which is formed in a thickness of 0.625 mm with crystal axis (111), for example. In this case, the ink supply port 8 can be formed by means of Si anisotropic etching. Also, as the electrodes 2 and 3, it is possible to use thin platinum film of 0.2 $\mu$m thick, for example. For the heat accumulation layer 4, it is possible to use the thermal oxidation Si film, which is formed in a thickness of 2.75 $\mu$m. Also, the nozzle formation member 7 can be formed with resin, and the ink supply port 8 can be formed by means of Si anisotropic etching.

For the ink jet recording head of the present embodiment, PTC thermistor heat generating element is used for the PTC thermistor layer 1. The PTC thermistor heat generating element is the resistive heat generating element having the positive temperature coefficient, which enables the resistance value to rise abruptly when the temperature thereof becomes higher than a predetermined temperature (curie point).

Figure 3:
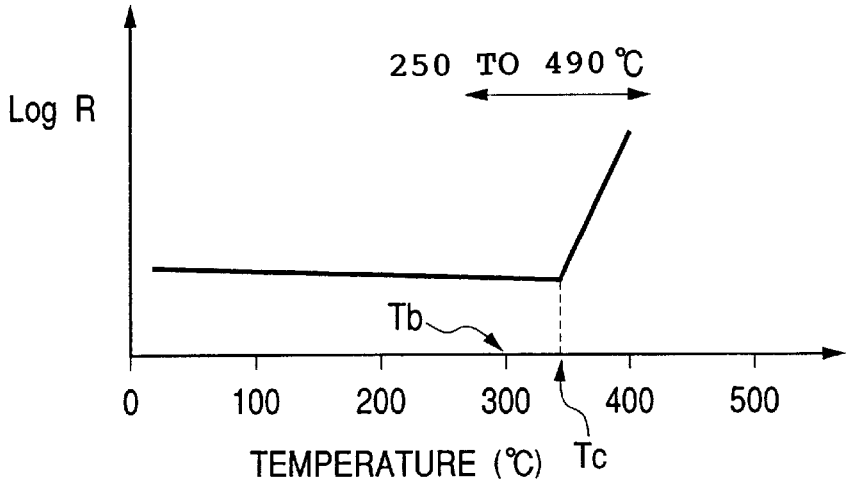
FIG. 3 is a graph that shows the temperature dependency of the resistance value of the resistive heat-generating element, which is used for the ink jet recording head represented in FIG. 1.

FIG. 3 is a graph that shows schematically the resistance value (R)—temperature characteristic of the PTC thermistor, which can be used preferably as the PTC thermistor layer 1 of the present embodiment. In FIG. 3, a reference mark Tb designates bubbling temperature. In other words, the ink, which is bubbled at a temperature of approximately 300° C., is used as liquid for this example. On the other hand, a reference mark Tc designates the curie point of the PTC thermistor heat-generating element. Here, it is preferable to set the curie point of the PTC thermistor heat-generating element used for the PTC thermistor layer 1 slightly higher than the bubbling temperature Tb. For the example shown in FIG. 3, it is approximately 350° C. As described here, the curie point may be set appropriately according to the bubbling temperature of liquid, but it is preferable to set the curie point of the PTC thermistor adopted for the heater for bubbling use of an ink jet recording head at 250 to 490° C. in consideration of the bubbling temperature of ink in general.

The PTC thermistor layer 1 of the kind can be formed with a thin film of $(Ba_{0.5}Pb_{0.5})TiO_3$ of 0.4 $\mu$m thick, in which barium titanic acid is doped in lead, for example. In this case, the specific resistance of the PTC thermistor heat-generating element is approximately 10 Ω·cm at the room temperature, and the curie point is approximately 350° C. Then, the specific resistance at a temperature of 400° C. is approximately 1000 Ω·cm. The heater for bubbling use is formed by use of this PTC thermistor as the PTC thermistor layer 1, and if the effective size of the heater is defined to be 20 $\mu$m×20 $\mu$m, the element resistance of this heater for bubbling use is approximately 100 Ω at the room temperature, and the element resistance is approximately 10 Ω at 400° C. If the voltage, the pulse width of which is approximately 1.0 $\mu$s and the pulse height of which is approximately 10V is applied to this heater for bubbling use, for example, current of 0.05A runs in condition where the temperature is lower than curie point, hence making it possible to discharge the discharge liquid droplet 12 at a speed of approximately 15 m/s by heating liquid with joule heat thus generated.

Also, for the thin insulating film layer, which serves as the electrical barrier layer, thin SiN film, thin $SiO_2$ film, metallic anode oxide film, or the like can be used. It is preferable to make the film thickness 1 nm or more and 100 nm or less. More preferably, it is 4 nm or more and 40 nm or less.

Figure 4:
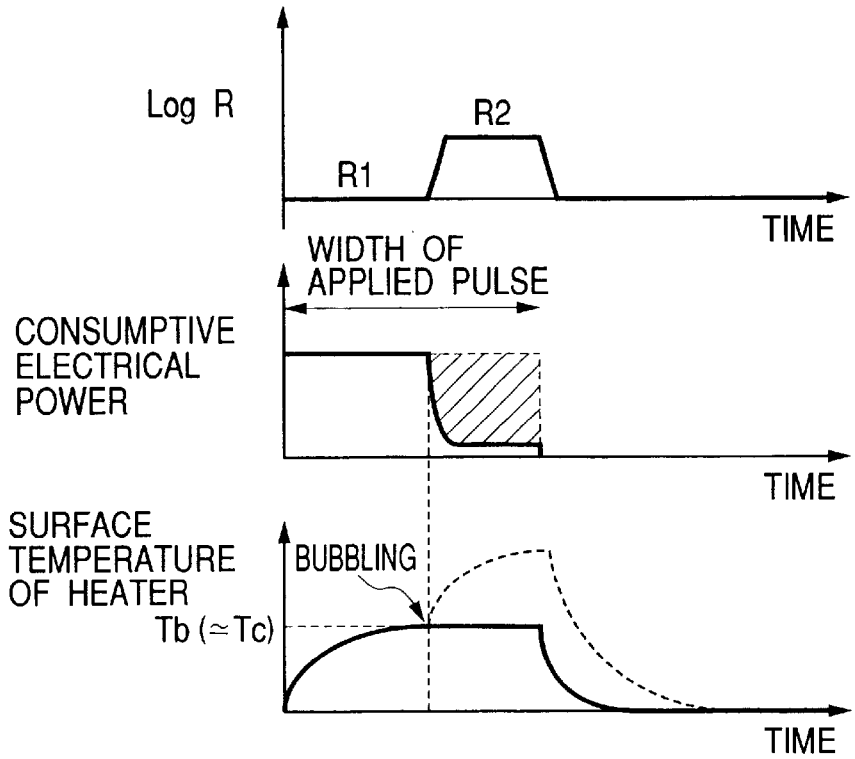
FIG. 4 are graphs that illustrate the temporal changes of resistance, power dissipation, heater-surface temperature of the resistive heat-generating element, respectively, in the liquid bubbling process using the ink jet recording head represented in FIG. 1.

Next, with reference to FIG. 4, the description will be made of the liquid bubbling process by use of this ink jet recording head. In FIG. 4, three graphs are shown to indicate the temporal changes of the resistance value R of the PTC thermistor layer 1, power dissipation, and the surface temperature of the heater for bubbling use in one and the same period of time. In the graphs of the power dissipation and heater surface temperature represented in FIG. 4, broken lines indicate the changes in a case of using the general resistive heating element that does not make much changes in the resistance value thereof when temperature changes within a range of designated temperatures for use.

As the conventional technology described earlier, the heater driving voltage is set for an ink jet recording head at a voltage higher than the voltage, which is capable of generating bubble on the entire surface of the average heater that usually does not exert much influence resulting from the variation of resistance in order to enable liquid to be bubbled reliably and sufficiently for the stabilized liquid discharge even when there is a slight variation in the resistance of finished resistive heat element, and resistance of wiring, which constitute the heater for bubbling use. For the present embodiment, too, this aspect is the same. More specifically, the driving voltage is set at a voltage approximately 1.2 times the voltage needed to generate bubble on the entire surface. Then, the graphs shown in FIG. 4 indicate the changes made in the average resistive heat generating element that does not exert much influence resulting from the variation of resistance.

When the application of voltage pulses begins, the surface temperature of heater rises at first to the bubbling temperature of liquid. Thus, bubbling of liquid begins. At this juncture, the thermal energy of the heater is consumed for the phase changes of liquid. Therefore, the heater surface temperature remains at a specific bubbling temperature as it is until bubbling is complete, that is, bubbling takes place on the entire surface. As described above, when a higher voltage is applied with a specific width of pulse application, liquid on the surface of heater is caused to bubble on the entire surface before the termination of voltage pulse application at a point after a certain period of time has elapsed since the beginning of the voltage pulse application. In accordance with the present embodiment, the driving voltage is set approximately 1.2 times the voltage needed for bubbling on the entire surface. In other words, energy of approximately 40% greater is inputted. As a result, against a specific width of applied pulse, 1 $\mu$s, for example, liquid is bubbled on the entire surface by approximately 60% thereof, that is, approximately 0.6 $\mu$s.

When the general resistive heat generating element, the resistance value of which does not change much even if the temperature changes after the entire-surface bubbling, is used, the heater surface temperature rises more than the bubbling temperature as indicated by the broken lines. More specifically, the heater surface temperature reaches typically a temperature of as high as approximately 600 to 700° C. against the bubbling temperature of approximately 300° C., for example. At this juncture, energy is consumed for such unnecessary heating (excessive heating). In other words, as described above, when the driving voltage is set at a voltage higher by approximately 1.2 times, approximately a 40% of energy is wastefully consumed in principle.

On the other hand, the structure of the present embodiment uses the PTC thermistor heat-generating element, the curie point of the temperature of which is slightly higher than the bubbling temperature, as the PTC thermistor layer 1. In this case, when the temperature of the PTC thermistor layer 1 rises more after the completion of bubbling, the resistance R of the PTC thermistor layer 1 is made large abruptly to the resistance R2, which is larger than the resistance R1 at the room temperature by more than 10 times usually, and almost no current runs on the PTC thermistor layer 1. As a result, in accordance with the present embodiment, the heater surface temperature rarely rises after the completion of the bubbling. To be specific, by the example shown in this embodiment, as the heater surface temperature approaches the curie point of approximately 350° C., the resistance of the heater for bubbling use rises abruptly from the resistance of 100 Ω at the room temperature to approximately 10 kΩ at 400° C. In this manner, whereas the general resistive heat generating element reaches a temperature of as high as approximately 600 to 700° C. when used, the present embodiment makes it possible to suppress the heater surface temperature dynamically to approximately 300° C., which almost the same as the bubbling temperature.

Also, after the completion of bubbling, almost no electrical current runs even if voltage is continuously applied. As a result, almost no electrical power is consumed. In other words, the electric power indicated by slanted lines in the graph of power dissipation shown in FIG. 4 can be saved. In accordance with the example of the present embodiment, approximately a 40% of electric power is saved.

Figure 5:
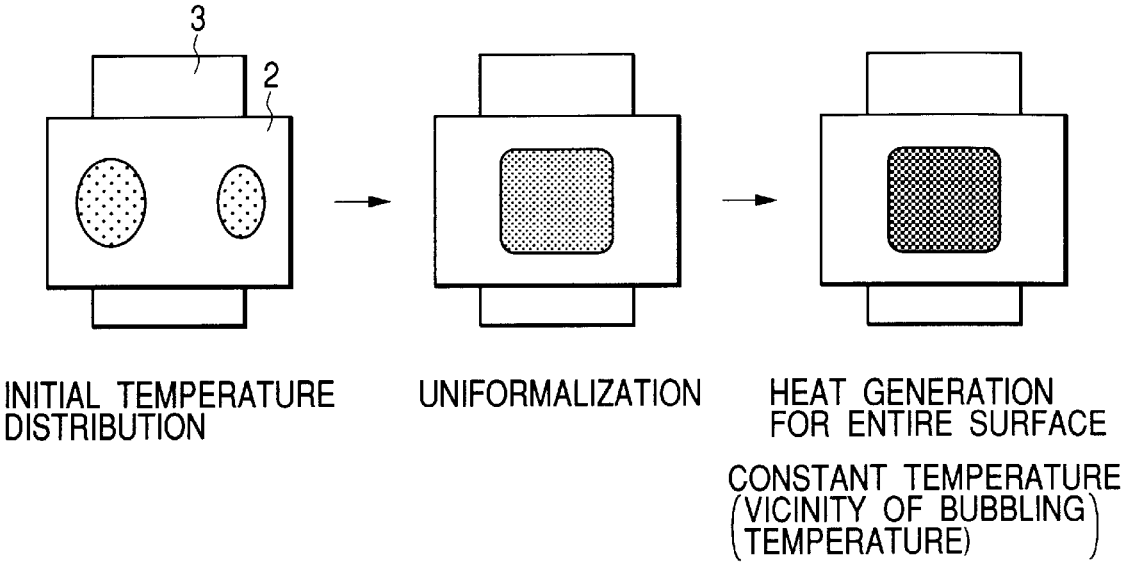
FIG. 5 is a conceptual view that shows the changes of in-plane temperature distribution of the non-linear current voltage element in accordance with the first embodiment of the present invention.

Also, FIG. 5 is a conceptual view that shows the changes of the in-plane temperature distribution of the element as the time elapses when a large current runs by the application of voltage to the non-linear current voltage element that sandwiches the PTC thermistor layer 1 and the electrical barrier layer 104 between a pair of electrodes 2 and 3.

As shown in FIG. 5, the non-linear current voltage element of the present embodiment suppresses the current value and heat generating on the portion where the temperature is high by the action of the PTC thermistor layer 1 the resistance value of which rises abruptly at a certain temperature even if the concentration of current occurs due to the influence of steps or the like, for example, so that the in-plane initial temperature distribution takes place where the high-temperature portion and the low-temperature portion are intermixed. As a result, the in-plane temperature distribution is uniformalized. Then, there is an effect eventually that the temperature is substantially constant to make heating possible uniformly on the entire surface. Particularly, by use of the PTC thermistor having the positive temperature coefficient that rises abruptly near the bubbling temperature of ink droplet, it is possible to provide a heat generating element capable of generating heat uniformly on the entire surface near the bubbling temperature of bubble jet ink.

Figure 9:
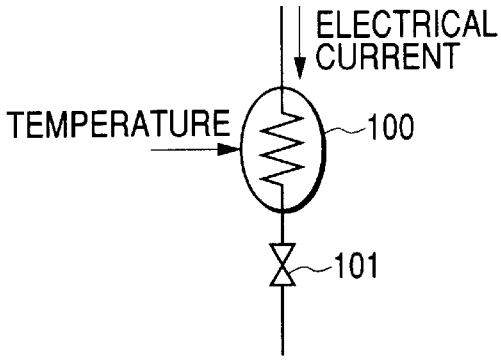
FIG. 9 is a circuit diagram that shows heat-generating means of the ink jet recording head of the present invention as an equivalent circuit of the MIM and PTC.
Figure 10:
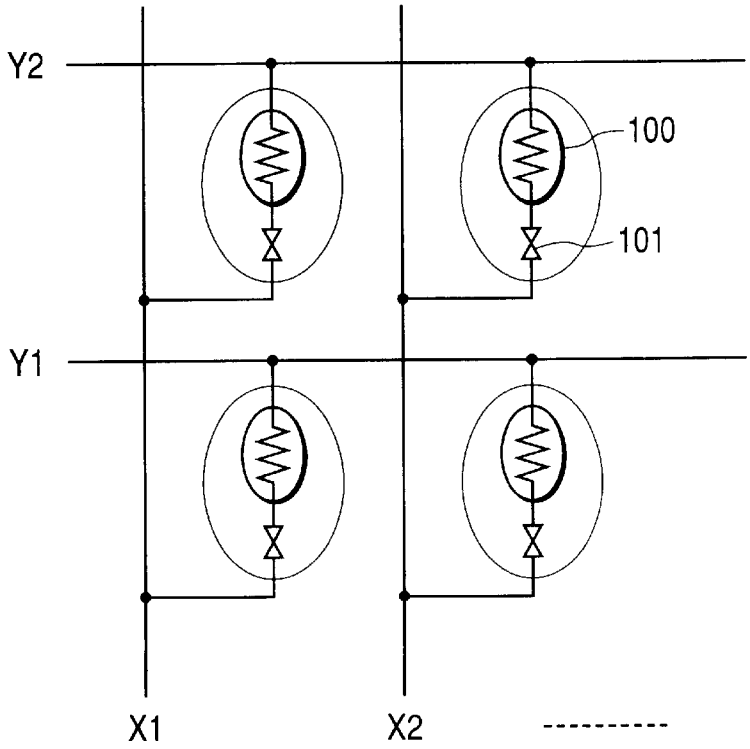
FIG. 10 is a matrix circuit diagram that shows the serial circuit of the MIM element and the PTC thermistor, which is arranged at the intersecting point of the matrix circuit.

As described above, in accordance with the present embodiment, the heater for bubbling use practically makes the serial circuit (see FIG. 9) of the MIM element, which is formed by the electrodes 2 and 3, and the electrical barrier layer 104, and the PTC thermistor layer 1. Thus, electrical current is not allowed to run at the time of voltage application if the applied voltage is lower than a predetermined voltage. The electrical current runs when a voltage higher than the predetermined one is applied, and then, automatically cuts the electrical current after liquid has been bubbled. In this way, the unnecessary heat generation of the heater for bubbling use is suppressed after bubbling. In this manner, it becomes possible to prevent the heater for bubbling use from being at a temperature higher than necessary for the enhancement of the durability thereof. Also, it is made possible that after bubbling electrical power is not consumed essentially by means of the PTC thermistor layer 1, thus attempting energy saving.

In this respect, the structure of the PTC thermistor layer 1 of the present embodiment is not necessarily limited to the one exemplified here. In other words, it is possible to obtain the effect of the present embodiment as described above by use of a PTC thermistor that generally provides the positive resistance temperature coefficient that enables resistance value to rise abruptly, when the temperature becomes higher than a predetermined temperature.

Second Embodiment

Figure 6:
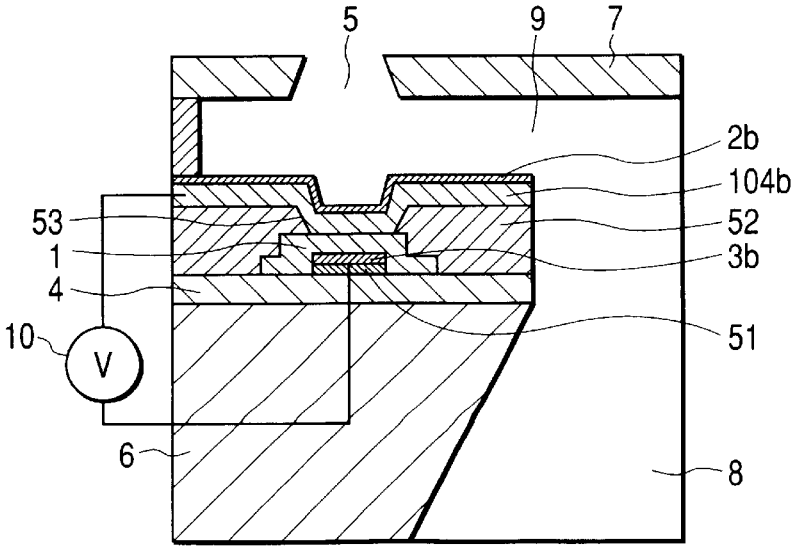
FIG. 6 is a cross-sectional view that schematically shows an ink jet recording head in accordance with a second embodiment of the present invention.
Figure 7:
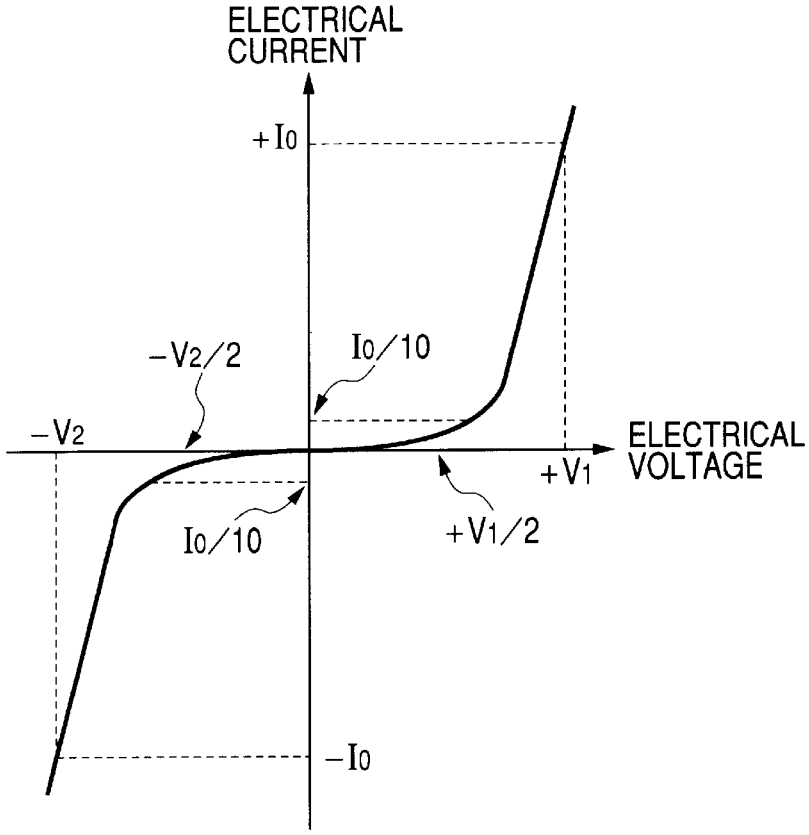
FIG. 7 is a conceptual view that shows the electrical characteristic of MIM type.
Figure 8:
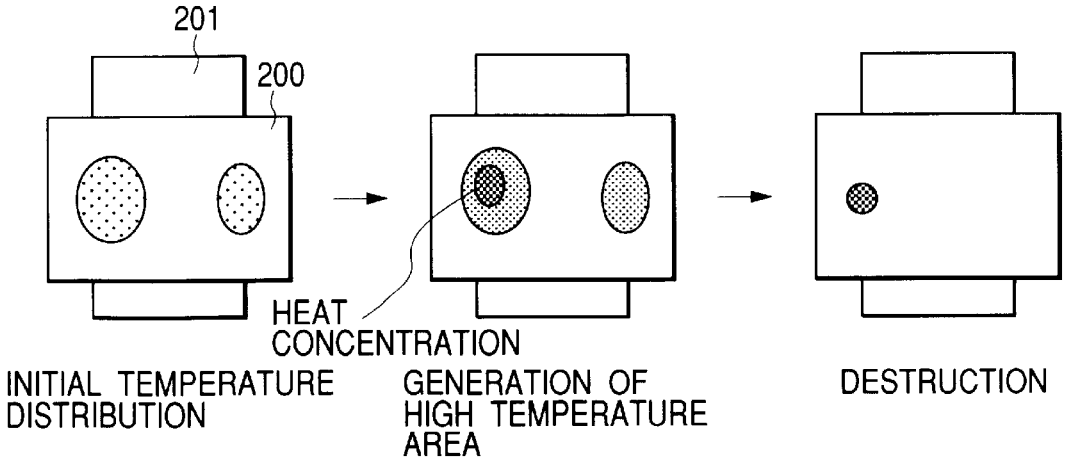
FIG. 8 is a conceptual view that shows the changes of in-plane temperature distribution of the convention MIM element.

FIG. 6 is a cross-sectional view that schematically shows an ink jet recording head in accordance with a second embodiment of the present invention. FIG. 6 shows one heater portion for bubbling use, and the entire body of the ink jet recording head may be structured with the arrangement of plural heater portions for bubbling use shown in FIG. 5. In FIG. 6, the same parts as those described in the first embodiment are given the same reference marks, and the description thereof will be omitted.

For the ink jet recording head of the present embodiment, the lower side electrode **3*b* is laminated on the heat accumulation layer 4 through the close-contact layer 51. Then, the layer of insulator 52 is formed on the lower side electrode 3*b* and the PTC thermistor layer 1 laminated thereon. For the layer of insulator 52, a contact hole 53 is formed in order to expose the upper face of the PTC thermistor layer 1 locally. The area other than this contact hole 53 covers the PTC thermistor layer 1. Then, the electrical barrier layer 104*b* is laminated on the insulator 52, and the upper side electrode 2*b* is laminated further thereon. In other words, the ink jet recording head of the present embodiment is structured so that the electrodes 2*b* and 3*b* sandwich the electrical barrier layer 104*b* and the PTC thermistor layer 1 in the contact hole 53**.

The layer of insulator 52 is thin SiN film of 1 $\mu$m thick, for example, and the electrodes **2*b* and 3*b* are the platinum electrode formed in a thickness of 0.2 $\mu$m. The close-contact layer 51 is the Ti close-close contact layer formed in a thickness of 0.05 $\mu$m. Also, the PTC thermistor layer 1** may be formed in the same structure as the first embodiment, and then, it makes possible to prevent the heater temperature from becoming excessively high as in the case of the first embodiment, hence reducing the power dissipation.

In accordance with the present embodiment, the insulator 52 covers the PTC thermistor layer 1, and the electrode **2*b* covers the portion of the insulator 52, which is exposed from the contact hole, and, therefore, it is not in contact with liquid. Then, a chemically stable material is used for the electrode 2*b***. For the aforesaid example, it is formed by platinum. In this way, it is made possible to prevent the heater for bubbling use from being damaged chemically, thus enhancing the durability of the heater for bubbling use.

As has been described above, in accordance with the ink jet recording head of the present embodiment, too, the heater for bubbling use practically makes the serial circuit (see FIG. 9) of the MIM element, which is formed by the electrodes **2*b* and 3*b*, and the electrical barrier layer 104*b*, and the PTC thermistor layer 1 as in the first embodiment. Thus, electrical current is not allowed to run at the time of voltage application even if the applied voltage is lower than a predetermined voltage. The electrical current runs when a voltage higher than the predetermined voltage is applied, and then, automatically cuts the electrical current after liquid has been bubbled. In this way, the unnecessary heat generation of the heater for bubbling use is suppressed after bubbling. In this manner, it becomes possible to prevent the heater for bubbling use from being at a temperature higher than necessary for the enhancement of the durability thereof. Also, it is made possible that after bubbling electrical power is not consumed essentially by means of the PTC thermistor layer 1**, thus attempting energy saving.

What is claimed is:

1. An ink jet recording head for discharging liquid by bubbling liquid with heat generating means, wherein said heat generating means is provided with a laminated member having a pair of electrodes, a resistance layer having a positive resistance temperature coefficient raising a resistance value thereof abruptly when a temperature thereof rises higher than a predetermined temperature, and an insulation layer for enabling electrical current to flow by application of a voltage higher than a predetermined voltage, and said pair of electrodes sandwiches said resistance layer having the positive resistance temperature coefficient, and said insulation layer.

2. An ink jet recording head according to claim 1, wherein the thickness of said insulation layer is 4 nm or more and 40 nm or less.

3. An ink jet recording head according to claim 1, wherein the temperature causing the resistance value of said resistance layer having the positive resistance temperature coefficient to rise abruptly is near the bubbling temperature of the liquid.

4. An ink jet recording head according to claim 1, wherein the temperature causing the resistance value of said resistance layer having the positive resistance temperature coefficient to rise abruptly is 250° C. or more and 490° C. or less.

5. An ink jet recording head according to claim 1, wherein said heat generating means is formed by serially connecting a MIM element and a PTC thermistor.

6. An ink jet recording head according to claim 1, wherein said insulation layer does not allow electrical current to flow by application of a voltage lower than the predetermined voltage, and allows electrical current to flow by application of the voltage higher than the predetermined voltage, and said resistance layer stops the flow of electrical current after the bubbling of the liquid.

7. An ink jet recording head according to claim 1, wherein the predetermined temperature is a curie point of said resistance layer.

8. An ink jet recording head, comprising:

a pair of electrodes;

a resistance layer having a positive resistance temperature coefficient raising a resistance value thereof abruptly when a temperature thereof rises higher than a predetermined temperature;

an insulation layer allowing electrical current to flow by application of a voltage higher than a predetermined voltage; and an insulating member having a contact hole formed therefor, wherein said pair of electrodes sandwiches said resistance layer having the positive resistance temperature coefficient, and said insulation layer in said contact hole.

9. A non-linear electrical element having a non-linear resistive characteristic, comprising:

a pair of electrodes;

a resistance layer having a positive resistance temperature coefficient raising a resistance value thereof abruptly when a temperature thereof rises higher than a predetermined temperature; and an insulation layer allowing electrical current to flow by application of a voltage higher than a predetermined voltage, wherein said pair of electrodes sandwiches said resistance layer having the positive resistance temperature coefficient, and said insulation layer.

10. A non-linear electrical element according to claim 9, wherein the thickness of said insulation layer is 4 nm or more and 40 nm or less.

11. A non-linear electrical element according to claim 9, wherein said non-linear element is a laminated structure formed by a serial circuit of a MIM element and a PTC thermistor.

12. A non-linear electrical element comprising:

a pair of electrodes;

a resistive heat generating element sandwiched between said pair of electrodes, having a positive resistance temperature coefficient raising a resistance value thereof abruptly when a temperature thereof rises higher than a predetermined temperature;

an electrical insulating element covering said resistive heat generating element, having a contact hole formed therefor to enable one electrode of said pair of electrodes to be electrically connected with said resistive beat generating element; and an insulation layer covering one of said electrodes in said contact hole to allow electrical current to flow by application of a voltage higher than a predetermined voltage.

13. An ink jet recording head for discharging liquid by generating a bubble in liquid with heat generating means, wherein said heat generating means is provided with a laminated member having a pair of electrodes, a resistance layer having a positive resistance temperature coefficient raising a resistance value thereof when a temperature thereof rises higher than a curie point thereof, and an insulation layer for enabling electrical current to flow by application of a voltage higher than a predetermined voltage, and said pair of electrodes sandwiches said resistance layer and said insulation layer.

* * * * *